United States Patent [19]

Friedman et al.

[11] Patent Number: 4,970,734

[45] Date of Patent: Nov. 20, 1990

[54] SHOWER STALL BATH

[76] Inventors: Moshe Friedman, 733 Eastern Pkwy., Brooklyn, N.Y. 11213; David Rohinsky, 84-30 118th St., Kew Gardens, Queens, N.Y. 11415

[21] Appl. No.: 248,622

[22] Filed: Sep. 26, 1988

[51] Int. Cl.[5] ..... A47K 3/07; A47K 3/23

[52] U.S. Cl. ..... 4/597; 4/580; 4/612; 4/585; 4/592

[58] Field of Search ..... 4/545, 546, 547, 548, 4/549, 550, 551, 552, 553, 554, 612, 613, 614, 597, 599, 600, 580, DIG. 18, 581, 582, 583

[56] References Cited

U.S. PATENT DOCUMENTS

| | | | |
|---|---|---|---|
| 1,235,091 | 7/1917 | Anderson | 4/552 |
| 2,420,448 | 5/1947 | Siers | 4/549 |
| 3,646,618 | 3/1972 | Johnson | 4/599 |
| 3,938,200 | 2/1976 | Roberts et al. | 4/DIG. 18 |
| 3,955,219 | 5/1976 | Finch et al. | 4/552 |
| 4,337,540 | 7/1982 | Lindeman | 4/556 |
| 4,512,044 | 4/1985 | Clark | 4/611 |
| 4,566,142 | 1/1986 | Roberts et al. | 4/DIG. 18 |
| 4,602,393 | 7/1986 | Fireash | 4/580 |

FOREIGN PATENT DOCUMENTS

| | | | |
|---|---|---|---|
| 693473 | 11/1930 | France | 4/550 |

*Primary Examiner*—Henry J. Recla
*Assistant Examiner*—Edward C. Donovan

[57] ABSTRACT

A shower stall booth is converted into a bath by supporting an integral sheet of waterproof material against the upstanding walls of the shower stall. Support components extend across the open side of the shower stall to further support the waterproof sheet. A second embodiment enables the waterproof insert to extend outward from within the stall shower to any desired length and breadth. A third embodiment enables the waterproof tub insert to extend upward to any desire height. Fourth and fifth embodiments accomplish the shower stall bath conversion by means of affixing either a watertight wall or a partial tub insert to the open side of the shower stall.

5 Claims, 4 Drawing Sheets

SHOWER STALL BATH

While this invention is subject to a wide range of applications, it is especially useful to transform a shower stall into a bath. More particularly, the shower stall can be converted to form a bathtub within the confines of the stall or a bathtub which extends outwardly from the shower stall.

In the past, shower stalls did not function both as a shower and as a bathtub. The present invention overcomes this limitation by providing a shower stall with a removable or permanent waterproof insert to be supported by removable or permanent structural elements.

Portable and collapsible showers were known in the past, as illustrated in U.S. Pat. No. 3,646,618 to Johnson. Johnson can be distinguished from the present invention in that it does not disclose or suggest the conversion of a shower into a bath.

In the medical environment, a shower with a framework covered by a disposable plastic liner, as disclosed in U.S. Pat. No. 4,566,142 to Roberts et al., maintains aseptic conditions. However, this patent disclosure is also distinguished from the present invention because the liner is not supported to enable it to function as a bath.

A liner for a bathtub, as disclosed in U.S. Pat. No. 4,602,393 to Fiveash, increases the depth of the bathtub. This liner is formed of an integral sheet of plastic material shaped to conform to the inner surface of the bathtub while extending above the upper surface thereof. The Fiveash disclosure can be distinguished from the present invention because the liner forms a bathtub within a bathtub as opposed to a bathtub within a shower stall. Also, the liner of Fiveash is supported by the inner walls of the tub and does not extend external thereto as with one embodiment of the present invention.

It is a problem underlying the present invention to provide a shower stall bath conversion which enables a stall shower to also function as a bath.

It is an advantage of the present invention to provide an apparatus which obviates one or more of the limitations and disadvantages of the described prior arrangements.

It is a further advantage of the present invention to provide an apparatus for converting a stall shower to a bath wherein the conversion can be made inexpensively and very quickly.

It is another advantage of the present invention to provide an apparatus for converting a stall shower to a bath wherein the bath extends to any desired length, breadth or height.

It is still another advantage of the present invention to provide an apparatus for converting a stall shower to a bath which conserves water and which can be portable.

Accordingly, in a first embodiment of this invention, there has been provided a shower stall converted into a bath by supporting an integral sheet of waterproof material against the three upstanding walls of the shower stall. Depending on the rigidity of the insert, support components extend across the open side of the shower stall to further support the waterproof sheet.

A second embodiment enables the waterproof sheet to extend outward from the stall shower to any desired length and breadth.

A third embodiment enables the insert to be raised to any desired height.

A fourth embodiment converts the shower stall into a bath by inserting a watertight barrier, such as a door or panel, in the open side of the stall.

A fifth embodiment converts the shower shall into a bath by attaching a partial tub to the open side of the stall.

BRIEF DESCRIPTION OF THE DRAWINGS

The invention and further developments of the invention are now elucidated by means of preferred embodiments shown in the drawings:

FIG. 11 shows how the insert is raised to full height, held up by a second row of suction cups;

FIG. 13 shows the insertion of watertight doors on the open side of the shower stall; and FIG. 14 shows a partial bathtub attached to the open side of the shower stall.

DETAILED DESCRIPTION OF THE PREFERRED EMBODIMENT

Figure 1:
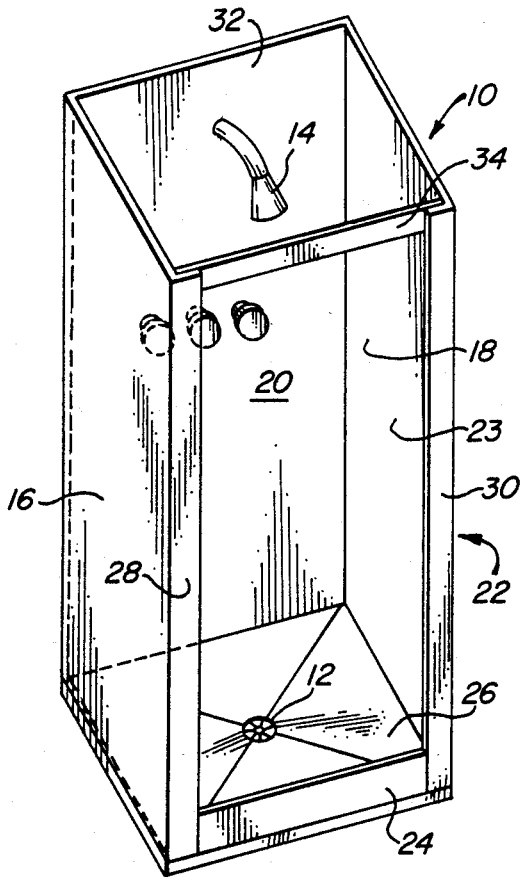
FIG. 1 is a three-dimensional representation of a conventional stall shower.

Referring to FIG. 1, there is shown a conventional shower stall 10 with an outlet drain 12 and a shower head 14. First, second and third walls 16, 18 and 20 form three sides of the shower stall and a fourth wall 22 having an opening 23 forms the fourth side. An upstanding lip 24 at the bottom of wall 22 is disposed at substantial right angles to the base 26 of the shower stall 10. The lip 24 prevents water, which builds up on the base 26, from flowing out of the shower stall. Narrow upstanding edge wall sections 28 and 30 extend on either side of the opening 23, from the base 26 to a ceiling 32. Typically, an upper edge 34 extends between the wall sections 28 and 30 and is adjoined to the ceiling 32.

Figure 2:
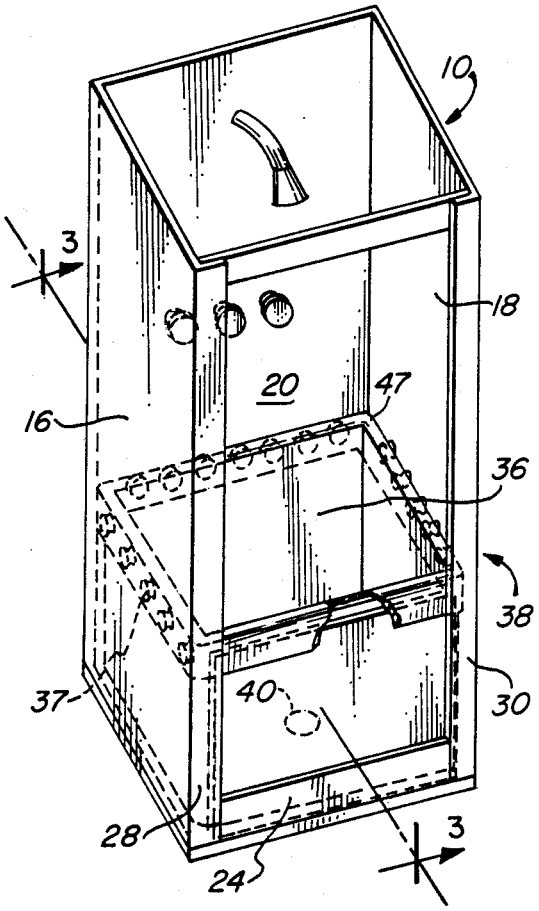
FIG. 2 is a three-dimensional representation of a stall shower incorporating a waterproof insert to form a bath in accordance with the present invention.
Figure 3:
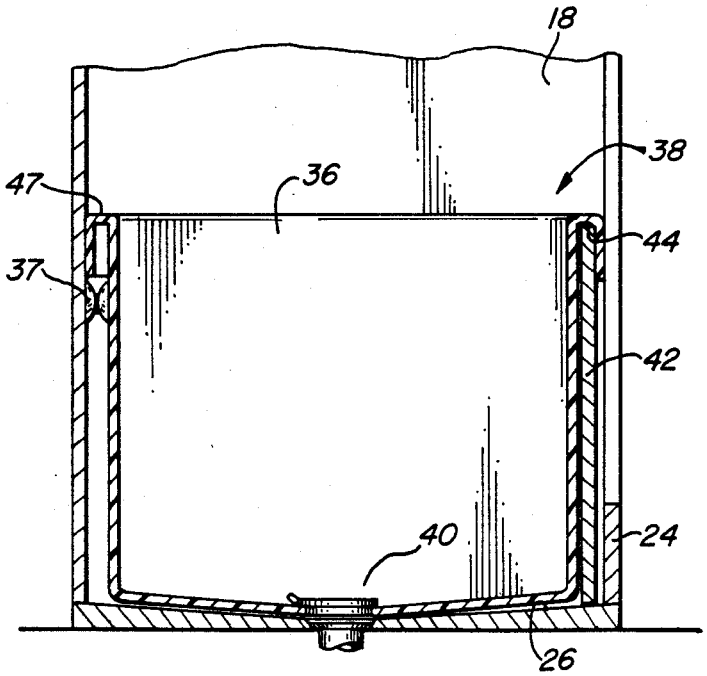
FIG. 3 is a view through 3—3 of FIG. 2 showing structural support elements on the open side of the shower stall, as well as suction cups suitable for supporting the insert on a stall wall.

Referring to FIGS. 2 and 3, the first embodiment of the invention, there is illustrated an integral sheet 36 of waterproof material supported by the three upstanding walls 16, 18 and 20 of shower stall 10. Common elements have the same reference numerals throughout the drawings. The waterproof sheet or insert 36 forming the tub has a drain opening 40 positioned to overlie the shower stall drain opening 12 so that water can be drained from the waterproof insert.

The insert can be made of any waterproof material such as plastic, vinyl, rubber or fiberglass, which can be of a wide range of stiffnesses, from very rigid to pliable and foldable. In all cases, the insert 36 can be made with a contoured shape so as to fit snugly inside the stall 10. The walls of the insert may be rigid enough to stand on their own or, when they are made of softer material, the walls of insert 36 can be held upright and flush against the three sides of stall 10 by any desired means, including adhesive tape, suction cups 37, or magnetic or velcro fasteners. The cups 37, or magnetic or velcro fasteners, can be embedded into the upper edge of the insert 36 and stuck to the walls of the stall as illustrated in FIG. 3. It is within the terms of the invention to prevent water from seeping between the stall walls and the insert 36 by affixing a conventional lip gasket 47 on the upper edge of insert 36. Other conventional sealing means include applying tape or adhesive material to affix the upper edge of insert 36 to the stall walls.

Another method of supporting the walls of the insert inside the stall is to make them with inflatable chambers.

The structural elements 38 shown in FIGS. 2 and 3 include a removable support panel 42, constructed of a rigid material such as hard plastic, fiberglass, metal or wood, positioned inside the opening 23 of the fourth wall 22, and extended substantially between the upstanding walls 16 and 18. The wall support 42 rests against the inner surfaces of the narrow wall sections 28 and 30 as well as the lip 24. The support panel can be clamped in place by any conventional means. The height of the support 42, extending above the base 26 of the shower stall, establishes the height of the bath. When the integral sheet 36 is folded over the top edge 44 of the wall support 42, as seen in FIG. 3, the water contained within the insert formed by the waterproof sheet 36 presses the wall support 42 against the lip 24 and wall sections 28 and 30 to further hold the support 42 in place.

Figure 4:
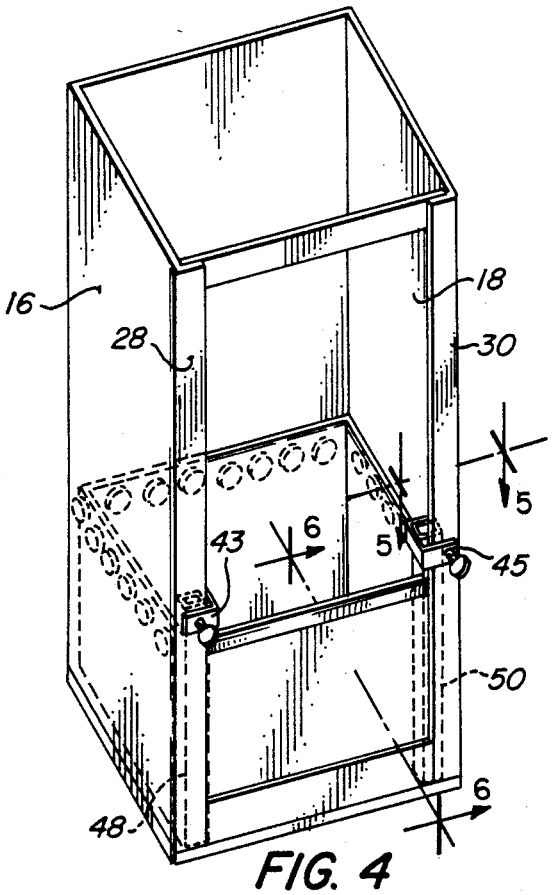
FIG. 4 illustrates a waterproof insert supported by vertical posts within the stall shower.
Figure 5:
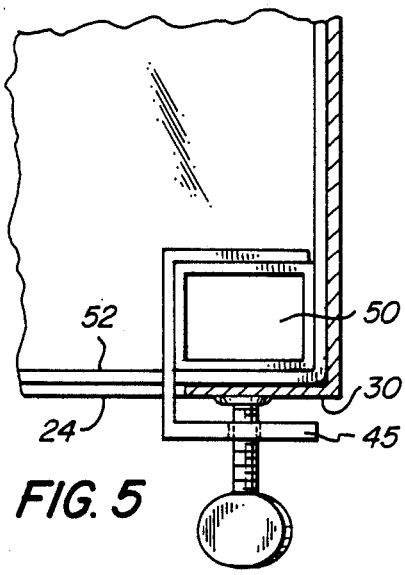
FIG. 5 is a view through 5—5 of FIG. 4.
Figure 6:
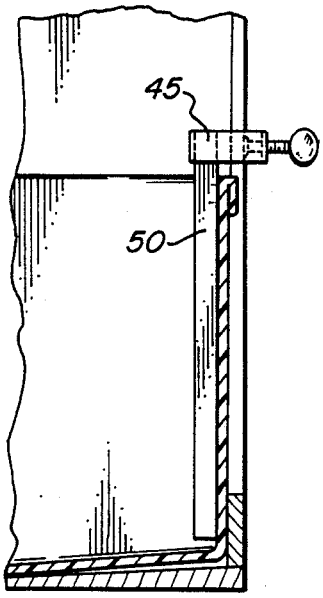
FIG. 6 is a view through 6—6 of FIG. 4.

A second arrangement of support elements, as illustrated in FIGS. 4–6, includes two support posts 48 and 50 which are removably affixed by clamps 43 and 45 to the corners between the wall sections 28 and 30 and the upstanding walls 16 and 18. The support posts 48 and 50 press the wall 52 of the integral sheet 36 between the sections 28 and 30 on both sides of the opening 23.

Figure 7:
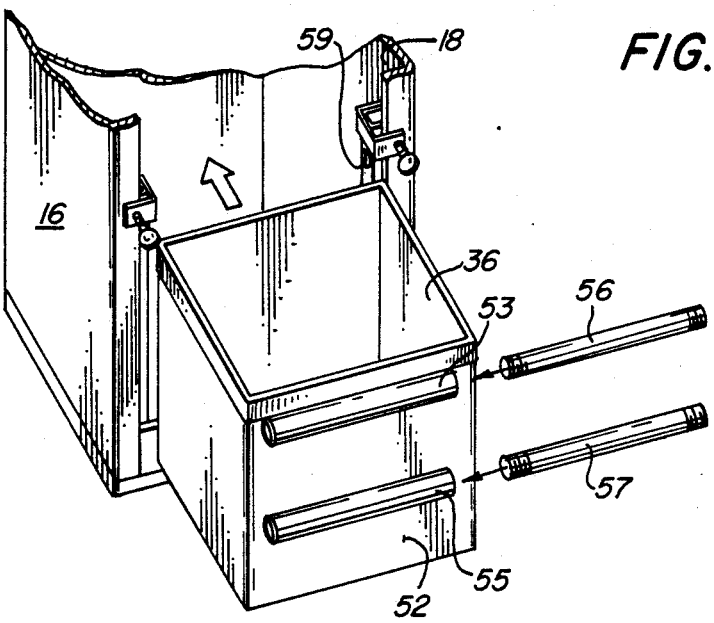
FIG. 7 illustrates a plurality of support poles placed through receiving sleeves formed in the waterproof insert.
Figure 8:
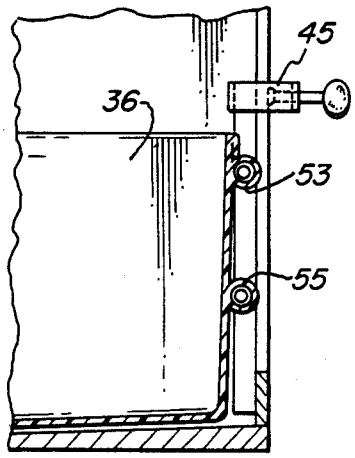
FIG. 8 is a partial cross-sectional view of the tub insert of FIG. 7 in place within the shower stall showing the positioning of the structural elements.

In a third arrangement of support elements, as illustrated in FIGS. 7 and 8, a plurality of sleeves 53 and 55 (or simply rows of looped straps, not shown), are provided on the front wall 52 of the waterproof sheet 36 Rods 56 and 57 are fitted within each of the sleeves 53 and 55 (or within the rows of looped straps) to extend substantially between the walls 16 and 18 of the shower stall. The rods can be held in place by any desired means such as insertion into holes 59 in support posts 48 and 50 as well as into holes in support clamps 43 and 45, not shown. Although two sleeves 53 and 55 and two rods 56 and 57 are illustrated, it is within the terms of the present invention to provide any number of sleeves and rods as required. Rods and sleeves may also be arranged vertically, as well as horizontally, in the opening, and they may be placed either inside or outside the tub insert.

Figure 9:
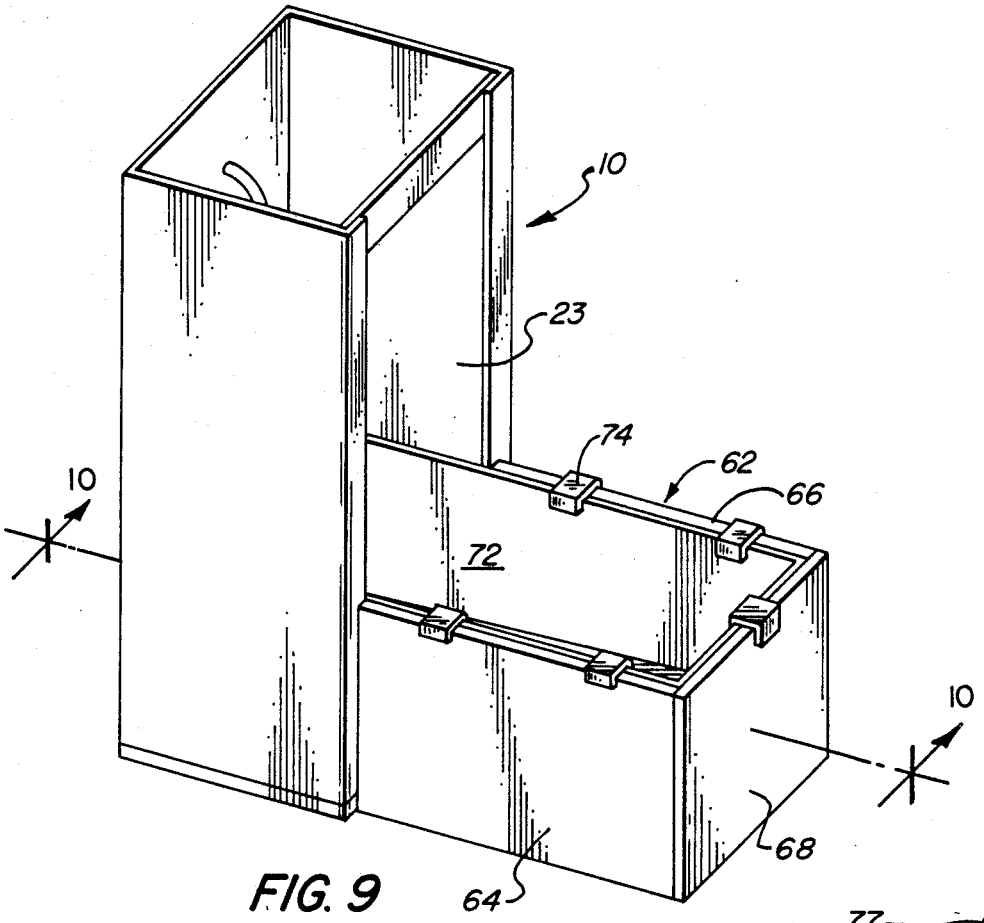
FIG. 9 illustrates a frame extension for extending the inserted tub from the stall shower.
Figure 10:
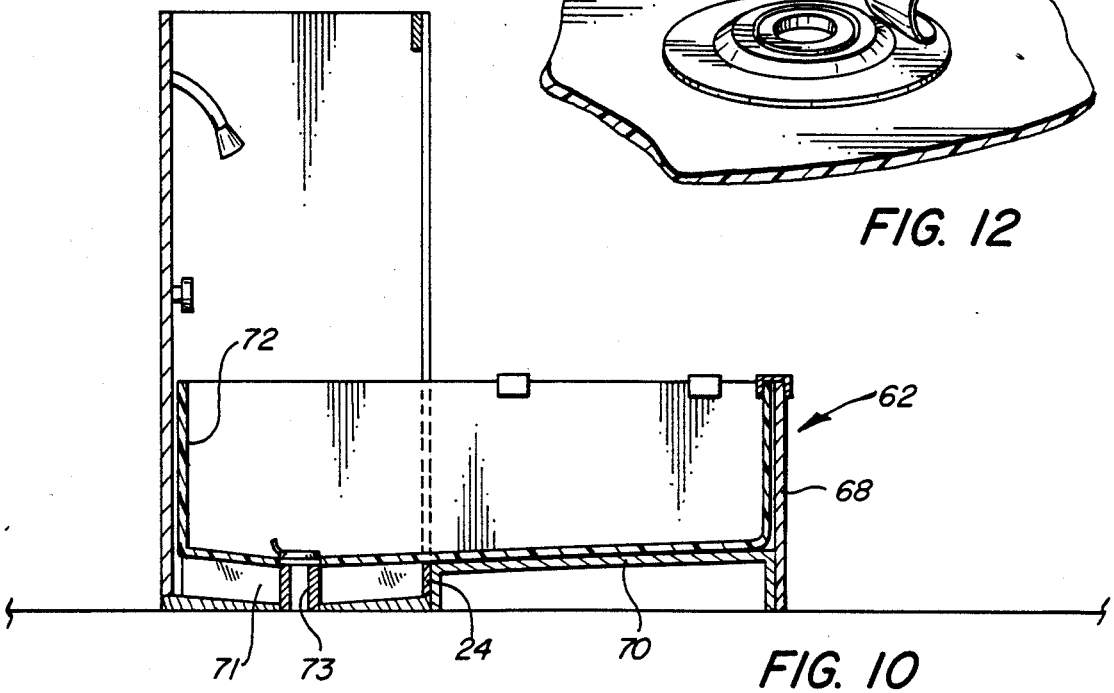
FIG. 10 is a view through 11—11 of FIG. 9.

A second embodiment of the present invention extends the bath beyond the walls of the shower stall. As illustrated in FIGS. 9 and 10, a frame 62 disposed adjacent the opening 23, extends to any desired distance from the shower stall 10. The frame supports a tub insert 72 of any desired length or breadth. The frame 62 includes two side walls 64 and 66, an end wall 68, and a base 70. The frame 62 can be constructed of any desired material which is strong enough to support a waterproof insert 72 filled with water and a bather. The insert 72 is constructed of the same materials as insert 36 and can be affixed to the frame by any desired means, such as clips 74.

The frame 62 can be constructed with a slightly inclined base 70 so that the water will drain over the lip 24 of the shower stall 10. The top of the base 70 may be curved, to give the insert a concave shape, as in a conventional bathtub, or substantially rectangular, as the base of the shower stall. To make the depth of the bath the same inside and outside the shower stall, a base 71 with a hole 73 in its center can also be placed underneath the insert inside the stall. The base 71 can also be either flat or curved to conform to the shape of the base 70.

The frame 62 and base 70 can be constructed of several sections that snap together or fit inside one another and then telescope to adjust the bath to various lengths. This is shown in FIGS. 9 and 10, where the side walls 64 and 66 are divided into telescoping sections **64*a* and 64*b* and 66*a* and 66*b*, and the base 70 is divided into sections 70*a* and 70*b***.

The frame 62 can also be constructed of rods, not shown, to which the insert is merely clipped, or which are inserted into sleeves in the edge of the insert extension, similar to the method depicted in FIG. 7. These rods can also be made to telescope to any desired length. For example, the frame can be fully compacted against side 22 of the shower stall, or fully extended to the length of a standard bathtub, or longer. When the frame is compacted, the excess plastic of the foldable insert extension will lie flat against the bottom and sides of insert 72. The telescoping frame and its base can be folded up out of the way or simply removed when the shower stall bath is not in use. When the inserted tub is made of rigid enough material, a separate frame and base are not needed for support.

A third embodiment of the present invention, as illustrated in FIG. 11, allows the bath to be raised to any desired height. The walls of the inserted flexible plastic tub can be, for example, 4 feet (or more) high, with two (or more) rows 78,80 of suction cups, one at two feet high and the other at four feet. When the higher suction cups are applied to the wall of the shower stall right adjacent to the lower suction cups, and the clamps 43 and 45 are also lowered to two feet, the excess plastic will fold over and hang down one foot below what is now the top of the tub; i.e., just over 2 feet high. By adjusting the position of both rows of suction cups, one can change the height of the bath from a few inches to many feet. The adjustable height of the bath is beneficial, for it allows the bather to step into the bath and then raise the walls to a position higher than he normally is able to step over. The height of the bath can also be adjusted through use of velcro or magnetic fasteners and/or strips.

Structural elements on the open fourth side 22 of the shower stall can be added to further support the greater water pressure when the height is raised. For example, instead of a single panel 42 as in FIGS. 2 and 3, a wall could be constructed of two or more sections that pull up like a two-paned window; or the vertical support posts 48 and 50 shown in FIGS. 4–6 can be telescoping poles, and also as stated above, any required number of horizontal or telescoping vertical rods may be used (see FIGS. 7 and 8).

Where the height is raised higher than the hot and cold water handles, the insert can be constructed with a bulge that fits loosely over the handles or is contoured to them like a glove, and that is flexible enough to allow the handles to be turned.

When the tub insert is constructed of more rigid material, the height can still be adjusted through making all of its sides accordian pleated, or through making its sides to consist of two or more concentric side sections, one encompassing the other, so that the bather is able to pull up the outer side section and lock its bottom edge with watertight gaskets and clamps to the top edge of the inner section to increase the the height of the tub, or unlock and lower the outer side section to decrease the height of the tub.

It is also within the terms of the present invention to change the height in the extension area of the insert through use of similar methods as described above.

Figure 12:
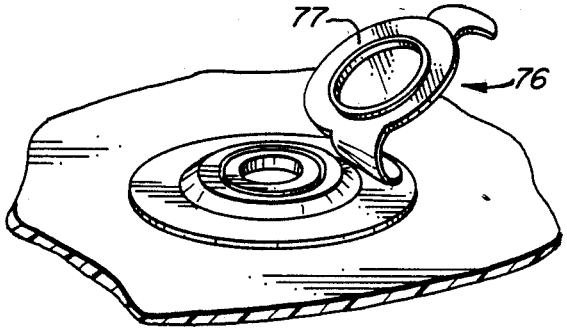
FIG. 12 illustrates a rubber stopper in the base of the insert suitable for the present invention.

In each of the above described embodiments of the present invention, a drain cover 76, as seen in FIG. 12, can be constructed in the bottom of the waterproof tub insert. The drain cover 76 includes a flap 77 which can be raised or sealed into grooves to either drain or retain water in the tub. It is, however, within the scope of the present invention to use any other conventional stopper to retain the water within the tub. When the drain cover is opened to allow the water in the tub to drain out, the water will only go down the drain and not seep onto the floor outside the shower stall due to the pressure of the water inside the tub, which presses the bottom of the insert against the floor of the shower stall and effectively seals off any other exit for the water. In some instances, as when a base 71 is placed inside the shower stall, a simple gasket can be placed underneath the base and around the drain hole to insure that no water will leak out when draining.

In the fourth and fifth embodiments of the invention, as illustrated in FIGS. 13 and 14, the shower stall bath conversion requires sealing the seams inside the shower stall with silicone or rubberized waterproof calking (if the stall is not originally made of one piece), and then inserting a waterproof wall or partial tub in the shower stall's open side. The water is held in this tub by means of any conventional stopper.

In the fourth embodiment of the invention, as illustrated in FIG. 13, there is affixed on the open side of the shower stall a plurality of interlocking doors 82 that swing and lock closed against the upstanding wall section 28 of the stall 10. Gaskets 84 are provided between the doors, the wall sections 28 and 30, and the lip 24, in order to form a strong, watertight seal.

Although two doors are illustrated, it is within the terms of this invention to use any number of doors. Also, one or more removable panels can be substituted for the doors and clamped against the shower stall by any conventional means. These panels can be of flexible or rigid construction. Suitable clamps and gaskets will be employed, depending on the specific construction of the doors and/or panels.

A fifth embodiment of the present invention, as illustrated in FIG. 14, includes a rigid, partial tub 86 attached to the open side of the shower stall by means of suitable gaskets 88 and clamps 90. The partial tub extension 86 can also be made of interlocking sections that attach together with gaskets and clamps so that the length, breadth and height of the tub may be adjusted. A partial tub insert and frame (similar to that described in the second embodiment) may also be substituted for the rigid, partial tub as illustrated.

For each embodiment of the invention, any conventional shower head extender can be employed to move the water spout to bath level as desired.

The patents cited in this application are intended to be incorporated in their entirety by reference herein.

It is apparent that there has been provided in accordance with this invention a shower stall bath which satisfies the objects, means and advantages set forth hereinabove. While the invention has been described in combination with the embodiments thereof, it is evident that many alternatives, modifications and variations will be apparent to those skilled in the art in light of the foregoing description. Accordingly, this application is intended to embrace all such alternatives, modifications and variations as fall within the spirit and broad scope of the appended claims.

What is claimed is:

1. An apparatus for converting an existing bathroom shower stall having a front entrance wall, two side walls, a rear wall, and a floor with a drain opening, into a bathtub for an adult, said apparatus comprising:

(a) a rigid frame adapted to be attached adjacent the front entrance wall of said shower stall, said frame extending from the entrance wall of said shower stall to a location a distance from said stall and forming with the shower stall a bathtub frame, said frame adapted to be supported by the bathroom and shower stall floors;

(b) a flexible waterproof insert including means adapted to be removably attached within said shower stall along the rear and two sidewalls and extending outwardly of the shower stall entrance into said rigid frame, said insert being formed in the shape of a bathtub and including means adapted to be removably attached to said frame, and said insert having a closeable drain opening at the bottom thereof adapted to be positioned over the drain opening of said shower stall, whereby said insert may be filled with water forming an elongated bathtub extending out of the shower stall, and said rigid frame and shower stall walls support the sides of said insert to retain water.

2. The apparatus of claim 1 wherein the insert is made of material selected from the group consisting essentially of flexible and foldable plastic, rubber, vinyl and fiberglass.

3. The apparatus of claim 1 wherein said means adapted to be removably attached within said shower stall of the insert on the walls of the shower stall is selected from the group comprising suction cups, magnetic fasteners, velcro fasteners, and waterproof adhesive and tape.

4. The apparatus of claim 1 wherein said frame includes a bottom platform for supporting the part of the insert that extends outside the shower stall, to drain water to the drain opening in the waterproof insert.

5. The apparatus of claim 1 further including a base platform placed underneath the part of the insert within the shower stall to make the bottom of the length of the tub level both inside and outside the stall; said platform having a hole positioned between the drain of the shower stall and the closeable drain hole of the insert to drain water from the stall.

* * * * *